US007458876B2

(12) United States Patent
Laurienzo et al.

(10) Patent No.: US 7,458,876 B2
(45) Date of Patent: Dec. 2, 2008

(54) DUAL-WHEELED REMOTELY CONTROLLED VEHICLE

(75) Inventors: Dominic Laurienzo, Los Angeles, CA (US); Brendon Vetuskey, Van Nuys, CA (US)

(73) Assignee: Jakks Pacific, Inc., Malibu, CA (US)

( * ) Notice: Subject to any disclaimer, the term of this patent is extended or adjusted under 35 U.S.C. 154(b) by 235 days.

(21) Appl. No.: 11/341,407

(22) Filed: Jan. 26, 2006

(65) Prior Publication Data

US 2006/0128268 A1 Jun. 15, 2006

Related U.S. Application Data

(63) Continuation-in-part of application No. 11/183,118, filed on Jul. 14, 2005, and a continuation-in-part of application No. 11/181,698, filed on Jul. 13, 2005.

(60) Provisional application No. 60/730,080, filed on Oct. 24, 2005, provisional application No. 60/604,283, filed on Aug. 25, 2004.

(51) Int. Cl.
*A63H 17/00* (2006.01)

(52) U.S. Cl. ..... 446/465; 446/288; 446/471

(58) Field of Classification Search ..... 446/431, 446/288, 89, 465, 466, 468–471, 289; 180/218, 180/22, 7.1
See application file for complete search history.

(56) References Cited

U.S. PATENT DOCUMENTS

| | | | | |
|---|---|---|---|---|
| 3,733,739 | A | 5/1973 | Terzian | |
| 3,742,507 | A | 6/1973 | Pirre | |
| 3,748,780 | A | 7/1973 | Glass et al. | |
| 4,021,961 | A * | 5/1977 | Good | 446/469 |
| 4,193,597 | A | 3/1980 | Ogawa | |
| 4,248,011 | A * | 2/1981 | Shimamura | 446/456 |
| 4,299,301 | A | 11/1981 | Janin | |
| 4,547,166 | A | 10/1985 | Goldfarb et al. | |
| 4,623,317 | A * | 11/1986 | Nagano | 446/289 |
| 4,693,696 | A | 9/1987 | Buck | |
| 4,696,655 | A | 9/1987 | D'Andrade et al. | |
| 4,717,367 | A | 1/1988 | Stubenfoll et al. | |
| 4,732,569 | A | 3/1988 | Hippely et al. | |

(Continued)

FOREIGN PATENT DOCUMENTS

| | | |
|---|---|---|
| WO | WO 00/07681 | 2/2000 |

*Primary Examiner*—Gene Kim
*Assistant Examiner*—Urszula M Cegielnik
(74) *Attorney, Agent, or Firm*—Tope-McKay & Associates

(57) ABSTRACT

A dual-wheel remotely controlled (RC) skateboard with two independently-controlled detachably attachable wheels is described. The RC skateboard comprises a body member having a right wheel and left wheel rotationally mounted proximate the body member. Each of the right and left wheels are drivably coupled with their own motors, such that each of the right and left wheels are independently controlled. Additionally, a quick release apparatus is included to provide for quick release of the wheels. Through use of the quick release apparatus, the wheels are interchangeable wheels and may be easily replaced with other interchangeable wheels. Furthermore, a skateboard deck is attached with the body member such that when the wheels are engaged, the skateboard deck is forced against a supporting surface, thereby preventing the body member from continuously spinning in place. Additionally, the detachably attachable wheels are formed to be used with devices other than a remotely controlled skateboard.

4 Claims, 11 Drawing Sheets

U.S. PATENT DOCUMENTS 4,832,651 A 5/1989 Buck
4,897,070 A * 1/1990 Wagstaff ..... 446/273
5,322,469 A 6/1994 Tilbor
5,338,247 A 8/1994 Miles
5,380,231 A 1/1995 Brovelli
5,643,036 A 7/1997 Liu et al.
5,643,041 A 7/1997 Mukaida
5,667,420 A 9/1997 Menow et al.
5,667,421 A 9/1997 Uetake
5,752,871 A 5/1998 Tsuzuki
5,803,790 A 9/1998 Tilbor et al.
5,860,846 A 1/1999 Uetake
5,919,075 A 7/1999 George et al.
5,921,843 A 7/1999 Skrivan et al.
5,951,363 A 9/1999 Uetake
6,193,582 B1 2/2001 Gleim
6,227,934 B1 5/2001 Isaksson et al.
6,439,948 B1 8/2002 Ostendorff et al.
6,475,059 B1 11/2002 Lee
6,589,098 B2 * 7/2003 Lee et al. ..... 446/465
6,648,722 B2 11/2003 Lynders et al.
6,764,374 B2 * 7/2004 Tilbor et al. ..... 446/465
6,939,197 B1 9/2005 Hoeting
7,033,241 B2 4/2006 Lee et al.

* cited by examiner

DUAL-WHEELED REMOTELY CONTROLLED VEHICLE

PRIORITY CLAIM

The present application is a Continuation-In-Part application, claiming the benefit of priority of U.S. patent application Ser. No. 11/183,118, filed Jul. 14, 2005, entitled "Toy for Rotating and Launching an Object," which is a non-provisional patent application claiming the benefit of priority of U.S. Provisional Patent Application No. 60/604,283, filed Aug. 25, 2004, entitled "Wheel Spinning Launcher and Wheel Toy." The present application also claims the benefit of priority of U.S. Provisional Application No. 60/730,080, filed Oct. 24, 2005, entitled, "Rotating Wheel/Propeller Toy," and of U.S. patent application Ser. No. 11/181,698, filed Jul. 13, 2005, entitled, "Remotely Controlled Vehicle with Detachably Attachable Wheels."

BACKGROUND OF THE INVENTION (1) Technical Field

The present invention relates to a remote controlled toy, and more particularly to a dual-wheeled, remotely controlled skateboard.

(2) Description of Related Art

Remotely controlled (RC) vehicles have long been known in the art. RC vehicles typically include four wheels, with the front two being devoted to steering, while the rear two are attached to a drive train for propulsion. In production, a problem associated with creating a RC vehicle with four wheels is the additional costs of a servo mechanism to control the steering, and the additional costs of four as opposed to two wheels.

Furthermore, when turning an RC vehicle that includes four wheels, the vehicle cannot turn on the spot. In other words, the turning radius for a four-wheeled RC vehicle requires that the RC vehicle travel either forward or backward in an arc. Because of this constraint, four-wheeled RC vehicles cannot spin in place or make extremely tight turns, and instead, must often make a several point turn.

Additionally, the wheels are typically permanently affixed with the body of the RC vehicle. In circumstances where the wheels are not permanently affixed, the wheels are held on by bolts or nuts, requiring the use of tools to remove the wheel. Should a prior art RC vehicle be used in a terrain where a different type of wheel would be advantageous, either the wheel cannot be changed, or changing the wheels requires considerable time and effort.

As an improvement over the prior art, U.S. patent application Ser. No. 11/181,698, entitled, "Remotely Controlled Vehicle with Detachably Attachable Wheels," discloses an RC vehicle having two quick-release interchangeable drive wheels. Because the invention disclosed in application Ser. No. 11/181,698 has only two wheels, in operation a rotary force is created that causes the invention to spin around itself. In some circumstances, it may be desirable to use a dual-wheeled RC vehicle that does not spin around itself.

Thus, a continuing need exists for a dual-wheeled, RC vehicle such as a RC skateboard that includes a device to prevent the RC skateboard from spinning around itself.

SUMMARY OF THE INVENTION

The present invention overcomes the aforementioned limitations and fills the aforementioned needs by providing a dual-wheeled remotely controlled vehicle. The dual-wheeled remotely controlled vehicle comprises a body member having a left portion, a right portion, a top portion, a bottom portion, a front portion, and a rear portion; a first motor attached with the body member for coupling with and driving right wheel; a second motor attached with the body member for coupling with and driving a left wheel; a receiver attached with the body member for receiving control signals from a remotely controlled transmitter, the receiver being independently connected with both the first and second motors such that a control signal from the remotely controlled transmitter provides for independent control of each of the first and second motors and their respective right and left wheels; and an elongated member connected with the top portion that extends beyond both the front portion and the rear portion, and where the elongated member further extends beyond the peripheral portions of the wheels, such that when the wheels are attached and engaged, the elongated member is forced toward a supporting surface, thereby preventing the body member from continuously spinning in place, whereby through use of a remotely controlled transmitter, a user can independently control each of the first and second motors, such that if the wheels are attached, uni-engagement of the left or right wheels alone causes the remotely controlled vehicle to turn, and bi-engagement of both the right and left wheels in opposite directions also causes the remotely controlled vehicle to turn, while bi-engagement in the same direction causes the remotely controlled vehicle to propel itself forward or reverse, thereby allowing a user to maneuver the remotely controlled vehicle in forward, reverse, left, and right directions.

In another aspect, the present invention further comprises a detachably attachable right wheel for drivably coupling with the first motor and rotationally mounted proximate the right portion of the body member for supporting the body member on a supporting surface, the right wheel having dimensions and a peripheral portion such that the peripheral portion of the right wheel extends beyond the bottom portion of the body member; and a detachably attachable left wheel drivably for coupling with the second motor and rotationally mounted proximate the left portion of the body member for supporting the body member on the supporting surface, the left wheel having dimensions and a peripheral portion such that the peripheral portion of the left wheel extends beyond the bottom portion of the body member.

In another aspect, the elongated portion is formed as a skateboard deck such that the remotely controlled vehicle is a dual-wheeled, remotely controlled skateboard.

In yet another aspect, the present invention further comprises a front wheel and a rear wheel rotatably attached with the front and rear portions respectively, such that when the detachably attachable wheels are attached and engaged, the elongated member is forced toward the supporting surface so that both the detachably attachable wheels and one of the front wheel and rear wheel engage with the supporting surface, depending upon directional engagement of the detachably attachable wheels.

In another aspect, the present invention further comprises a quick release apparatus attached with the body member for attaching the detachably attachable wheels, such that the detachably attachable wheels are detachably attachable with the body member through the use of the quick release apparatus, where actuation of the quick release apparatus releases at least one wheel, allowing for placement of another interchangeable wheel.

In another aspect, each detachably attachable wheel further comprises a receiving element, the receiving element including a notch and driving edge formed therein.

Additionally, the quick release apparatus further comprises a slide switch attached with the body member; a drum having tabs attached with the body member; a withdrawing member attached with the body member and operably connected with the slide switch, the withdrawing member having a catch for engaging with a driving edge of the receiving element, whereby a detachably attachable wheel may be attached with the quick release apparatus by sliding the receiving element into the drum such that the tab slides within the notch, the catch thereafter engaged with the driving edge, and when detaching the detachably attachable wheel, the slide switch is used to withdraw the withdrawing member such that the catch is withdrawn from the driving edge, thereby allowing the tab to be slid out of the notch which results in the removal of the detachably attachable wheel.

In yet another aspect, the present invention further comprises a remotely controlled transmitter configured to transmit control signals to the receiver, the remotely controlled transmitter having a first controller and a second controller, where the first controller is configured to control the first motor and its corresponding right wheel, and where the second controller is configured to control the second motor and its corresponding left wheel.

Furthermore, each motor is drivably coupled with a detachably attachable wheel through a driving element attached with each motor and a receiving element attached with each detachably attachable wheel, where the driving element is configured to engage with and impart a rotary motion to the receiving element.

Finally, as can be appreciated by one skilled in the art, the present invention also comprises a method for forming the RC vehicle. The method comprises acts of forming and connected all of the respective parts described herein.

BRIEF DESCRIPTION OF THE DRAWINGS

The objects, features and advantages of the present invention will be apparent from the following detailed descriptions of the disclosed aspects of the invention in conjunction with reference to the following drawings, where.

DETAILED DESCRIPTION

Figure 1:
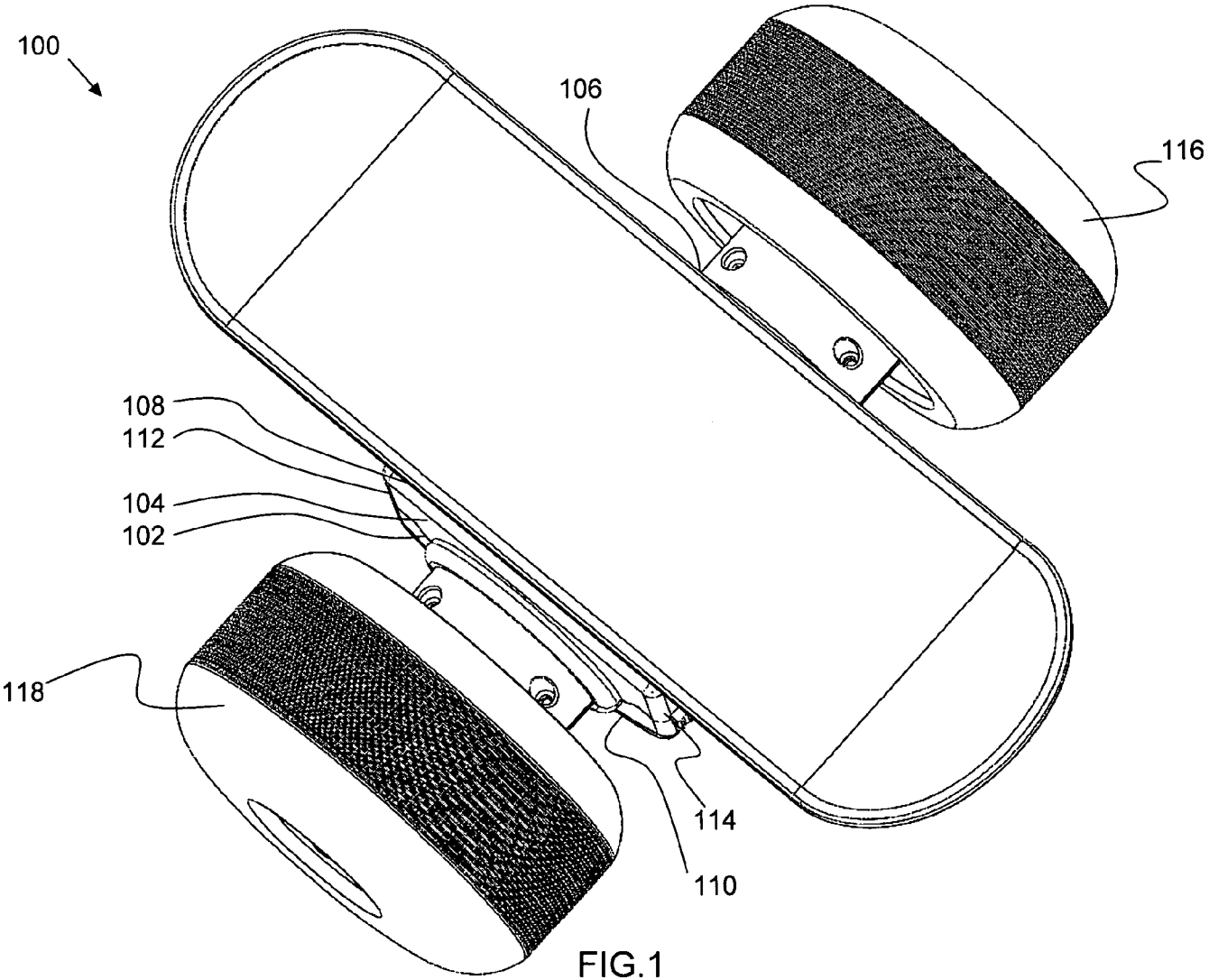
FIG. 1 is an illustration of a dual-wheeled remotely controlled vehicle according to the present invention.

The present invention relates to a remote controlled toy, and more particularly to a dual-wheeled, remotely controlled skateboard. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles, defined herein, may be applied to a wide range of aspects. Thus, the present invention is not intended to be limited to the aspects presented, but is to be accorded the widest scope consistent with the principles and novel features disclosed herein. Furthermore, it should be noted that unless explicitly stated otherwise, the figures included herein are illustrated diagrammatically and without any specific scale, as they are provided as qualitative illustrations of the concept of the present invention.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents that are filed concurrently with this specification and are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Note, the labels left, right, front, back, rear, top, bottom, forward, reverse, clockwise and counter-clockwise have been used for convenience only and are not intended to imply any particular fixed direction. Instead, they are used to reflect relative locations and/or directions between various portions of an object.

Before describing the invention in detail, an introduction is provided to provide the reader with a general understanding of the present invention. Next, a description of various aspects of the present invention is provided to give an understanding of the specific details.

(1) Introduction

The present invention relates to a dual-wheeled, remotely controlled (RC) vehicle, such as an RC skateboard. The RC skateboard includes a body member, a skateboard deck, and two wheels that are independently controlled to allow the RC skateboard to maneuver in forward, reverse, left, and right directions. When engaging both wheels, a rotary force is applied to the body member that forces an edge of the skateboard deck toward a supporting surface, thereby preventing the body member from spinning around itself.

Additionally, the wheels are detachably attachable and are configured to be used with other toys, such as a toy for rotating and launching a toy wheel. The toy includes a launcher that is formed to hold, rotate and release the toy wheel. A launcher with a pair of helical tabs extends from a shaft on the toy and interlocks with matching tabs on the toy wheel to mount the toy wheel on the shaft. In one aspect, a removable gear rack is pulled to rotate a gear train in the toy, which in turn rotates the shaft and the launcher, thereby rotating the toy wheel mounted to the launcher. When the launcher ceases to accelerate the toy wheel, the tabs of the toy wheel disengage from the launcher, launching the toy wheel forward. The launcher is configured to release the toy wheel in only one direction, and a stopper gear will prevent the toy from rotating the toy wheel in the direction of a user.

For purposes of clarity, the present invention will first be described in terms of the dual-wheeled, remotely controlled skateboard. Next, the toy for rotating and launching a toy wheel will be described in detail.

(2.1) Dual-Wheeled, Remotely Controlled Vehicle

The present invention relates to a dual-wheeled remotely controlled Vehicle. FIG. 1 illustrates a dual-wheeled remotely controlled (RC) vehicle 100 according to the present invention. The RC vehicle 100 includes a body member 102 formed in a suitable shape for encasing various components therein. As a non-limiting example, the body member 102 has a left portion 104, a right portion 106, a top portion 108, a bottom portion 110, a front portion 112, and a rear portion 114. Additionally, the body member 102 is constructed of any suitably durable material, a non-limiting example of which includes plastic. Furthermore, the body member 102 is formed such that it is water resistant, thereby protecting the RC vehicle 100 and its encased contents from aqueous elements.

A detachably attachable right wheel 116 is rotationally mounted proximate the right portion 106 of the body member 102, while a detachably attachable left wheel 118 is rotationally mounted proximate the left portion 104 of the body member 102. When attached, both the right wheel 116 and the left wheel 118 support the body member 102 when the RC vehicle 100 is placed upon a supporting surface. The body member 102 is formed such that the peripheral portions 120 of the right wheel 116 and left wheel 118 extend beyond the bottom 110 portions of the body member 102.

Figure 2:
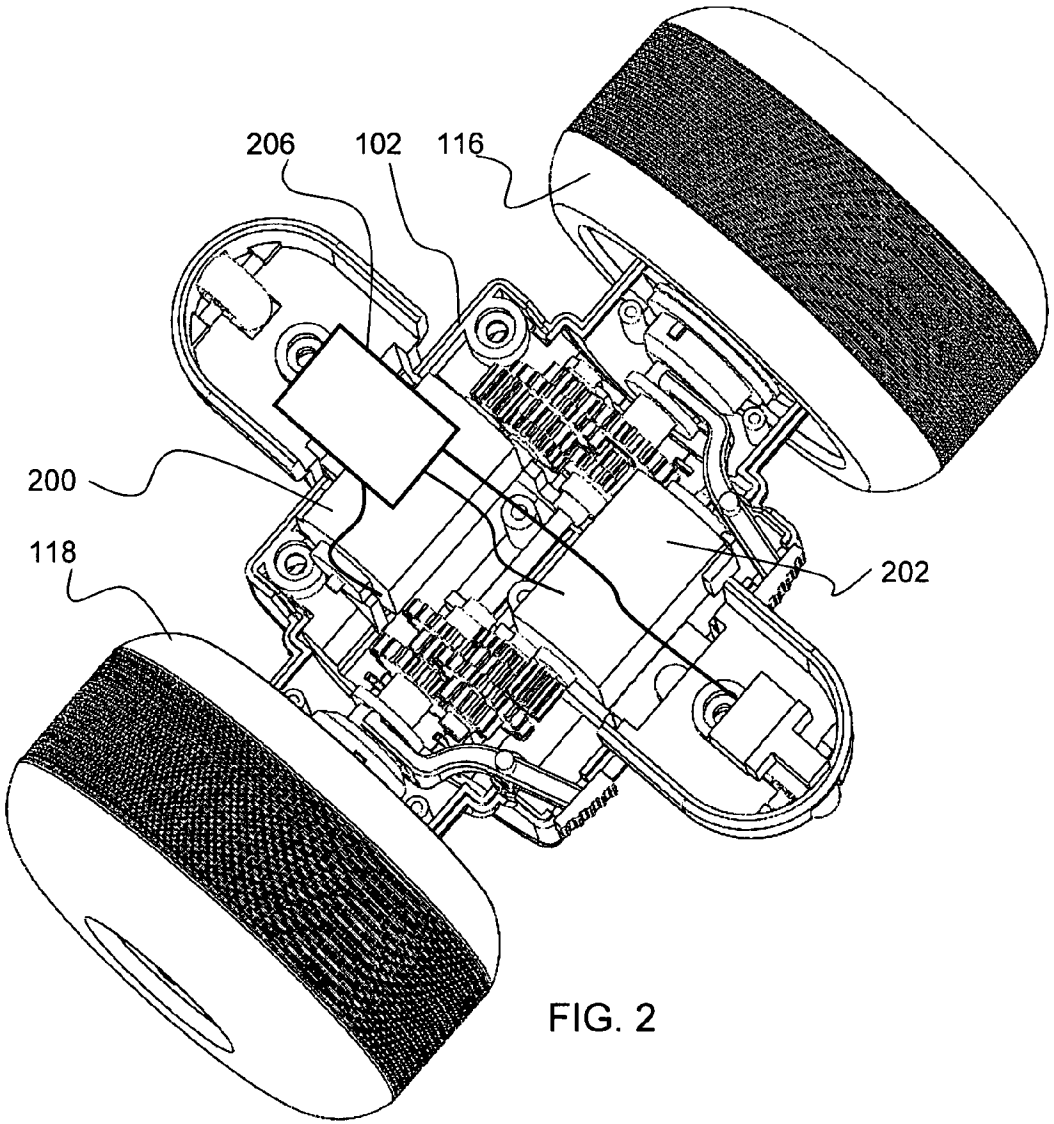
FIG. 2 is an interior-view illustration of the dual-wheeled remotely controlled vehicle according to the present invention.

FIG. 2 illustrates another view of the RC skateboard 100, showing various exemplary internal components encased within the body member 102. For example, a first motor 200 is drivably coupled with the right wheel 116. Additionally, a second motor 202 is drivably coupled with the left wheel 118. The first and second motors 200 and 202 are selected from any suitable type of motor for turning a wheel, non-limiting examples of which include electric and gasoline powered motors with rotable drive shafts. In a preferred aspect, the motors 200 and 202 are electric motors connected with a battery. A receiver 206 is included for receiving control signals from a remotely controlled transmitter. The receiver 206 is connected with the body member 102 in any suitable location, but is desirably encased within the body member 102. The receiver 206 is connected with both the first and second motors 200 and 202, such that a control signal from the remotely controlled transmitter provides for independent control of each of the first and second motors 200 and 202 and their respective right and left wheels, 116 and 118 respectively.

Figure 3:
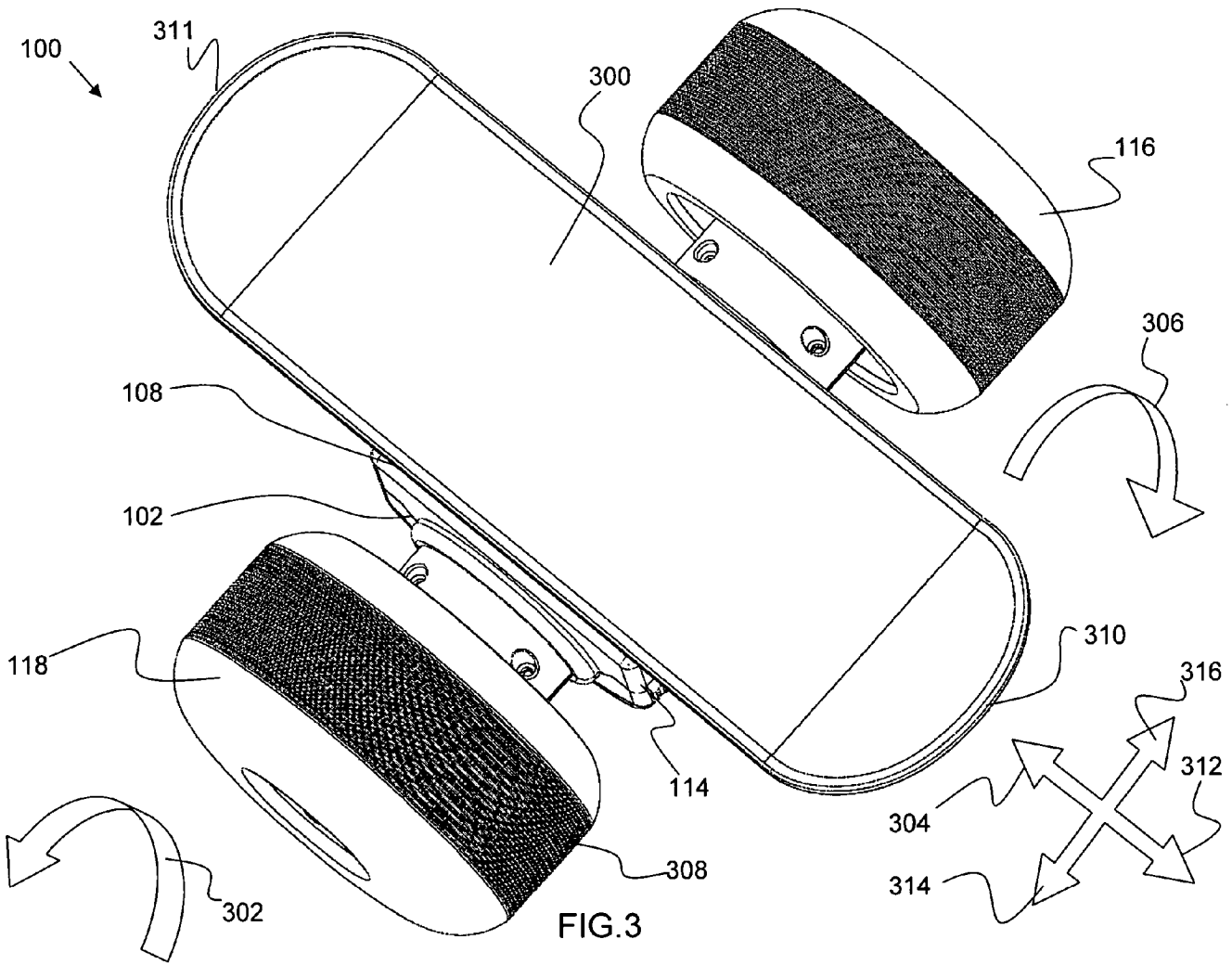
FIG. 3 is an illustration of the dual-wheeled remotely controlled vehicle according to the present invention.

As shown in FIG. 3, an elongated member 300 is attached with the top portion 108 of the body member 102. The elongated member 300 assists in preventing the body member 102 from spinning around itself (caused by a rotary force) when one or both of the motors are actuated. For example, when the motors are actuated in a clockwise direction 302 to propel the RC vehicle 100 forward 304, a counter-clockwise force 306 is applied to the body member 102, thereby creating a tendency for the body member 102 to spin around itself.

The elongated member 300 is attached with the top portion 108 such that it extends beyond both the front portion 112 and the rear portion 114. The elongated member 300 further extends beyond the peripheral portions 308 of the wheels 116 and 118, such that when the wheels 116 and 118 are attached and engaged, one of the outer edges 310 and 311 of the elongated member 300 is forced toward a supporting surface, thereby preventing the body member 102 from spinning in place. The outer edge 310 or 311 that is forced toward the supporting surface depends upon the direction of engagement.

Additionally, the elongated member 300 is formed as a skateboard deck such that the remotely controlled vehicle 100 is a dual-wheeled, remotely controlled skateboard. Furthermore, as can be appreciated by one skilled in the art, the elongated member 300 can be separately formed and attached with the body member 102 or integrally formed with the body member 102 as a single piece.

Furthermore, the RC vehicle 100 includes only two drive wheels, the right wheel 116 and the left wheel 118. Each of the wheels 116 and 118 are independently controlled by the receiver. By having only two drive wheels, each of which are independently controlled, the RC vehicle 100 is able to turn in tight radiuses, such that uni-engagement of the left 118 or right 116 wheels alone causes the RC vehicle 100 to turn, and bi-engagement of both the right 116 and left 118 wheels in opposite directions also causes the RC vehicle 100 to turn. Furthermore, bi-engagement in the same direction (i.e., either forward 304 or reverse 312) causes the remotely controlled car to propel itself forward 304 or reverse 312, thereby allowing a user to maneuver the RC vehicle 100 in forward 304, reverse 312, left 314, and right 316 directions.

Figure 4:
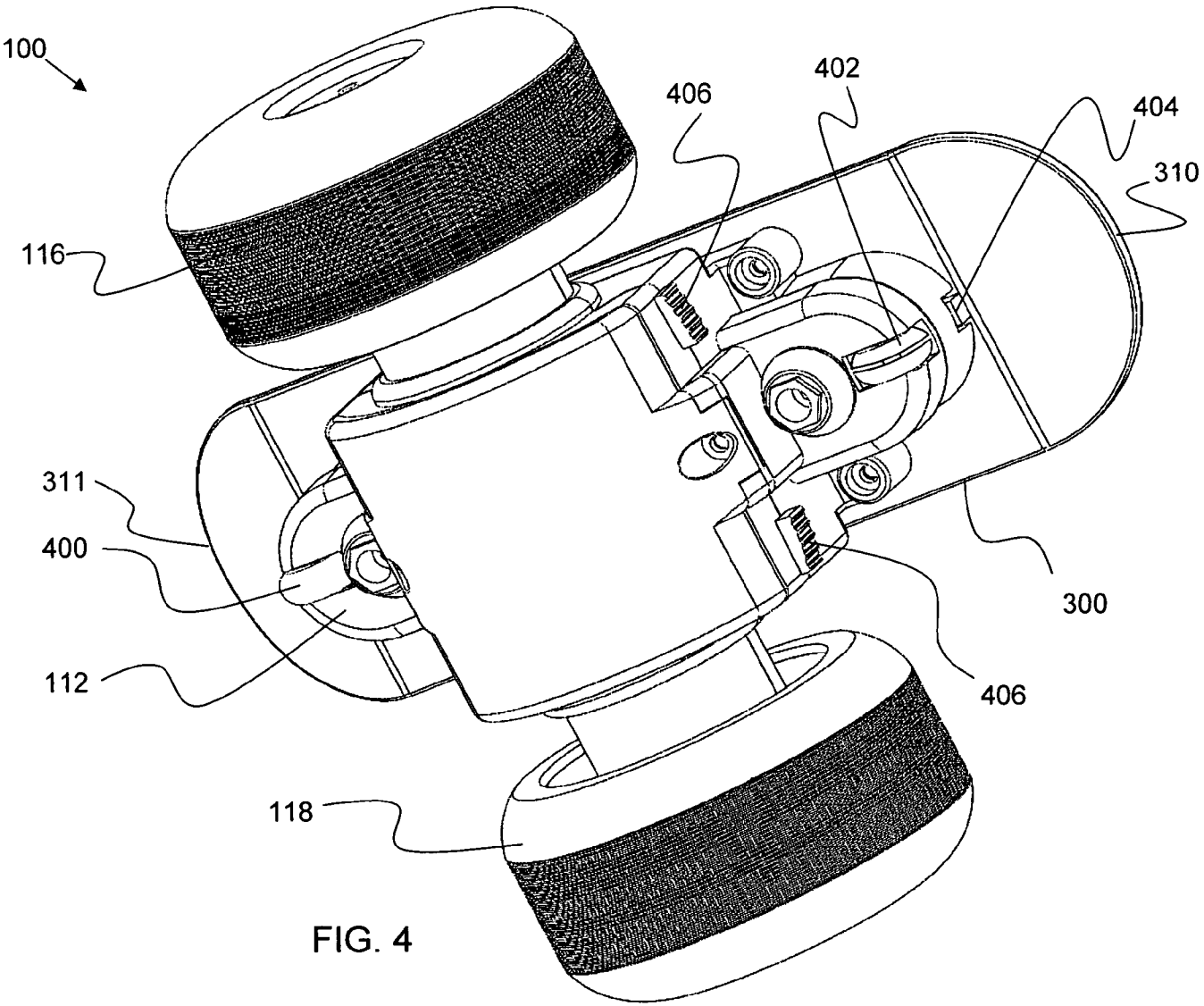
FIG. 4 is a bottom-view illustration of the dual-wheeled remotely controlled vehicle according to the present invention.

When forced toward the supporting surface, the outer edge would have a tendency to scrape and drag along the supporting surface. As shown in FIG. 4, to reduce friction and drag a front wheel 400 and a rear wheel 402 are rotatably attached with the front 112 and rear 114 portions respectively. Each of the front wheel 400 and rear wheel 402 can have a single wheel (as depicted by the front wheel 400), or they can have multiple wheels (as depicted by the dual rear wheel 402). Dual wheels for example (as depicted by the rear wheel 402) provide additional stability over a single wheel. As can be appreciated by one skilled in the art, although the front 400 and rear 402 wheels are discussed herein as having single wheels, they can include any number of suitable wheels.

When the detachably attachable wheels 116 and 118 are attached and engaged, one of the outer edges 310 and 310 of the elongated member 300 is forced toward the supporting surface so that both the detachably attachable wheels 116 and 118 and one of the front 400 and rear 402 wheels engage with the supporting surface, depending upon directional engagement of the detachably attachable wheels 116 and 118. The front 400 and rear 402 wheels allow the RC vehicle 100 to easily roll across a surface without having to drag any point of the vehicle 100.

Also shown in FIG. 4 is an on/off switch 404. The on/off switch 404 provides for activation of the RC vehicle 100. As can be appreciated by one in the art, the on/off switch 404 can be positioned at any suitable location on the RC vehicle 100.

Another aspect of the present invention is its quick-release and interchangeable wheels 116 and 118. The wheels 116 and 118 are detachably attachable through the use of a quick release apparatus 406. the quick release apparatus will be described in further detail below.

Figure 5:
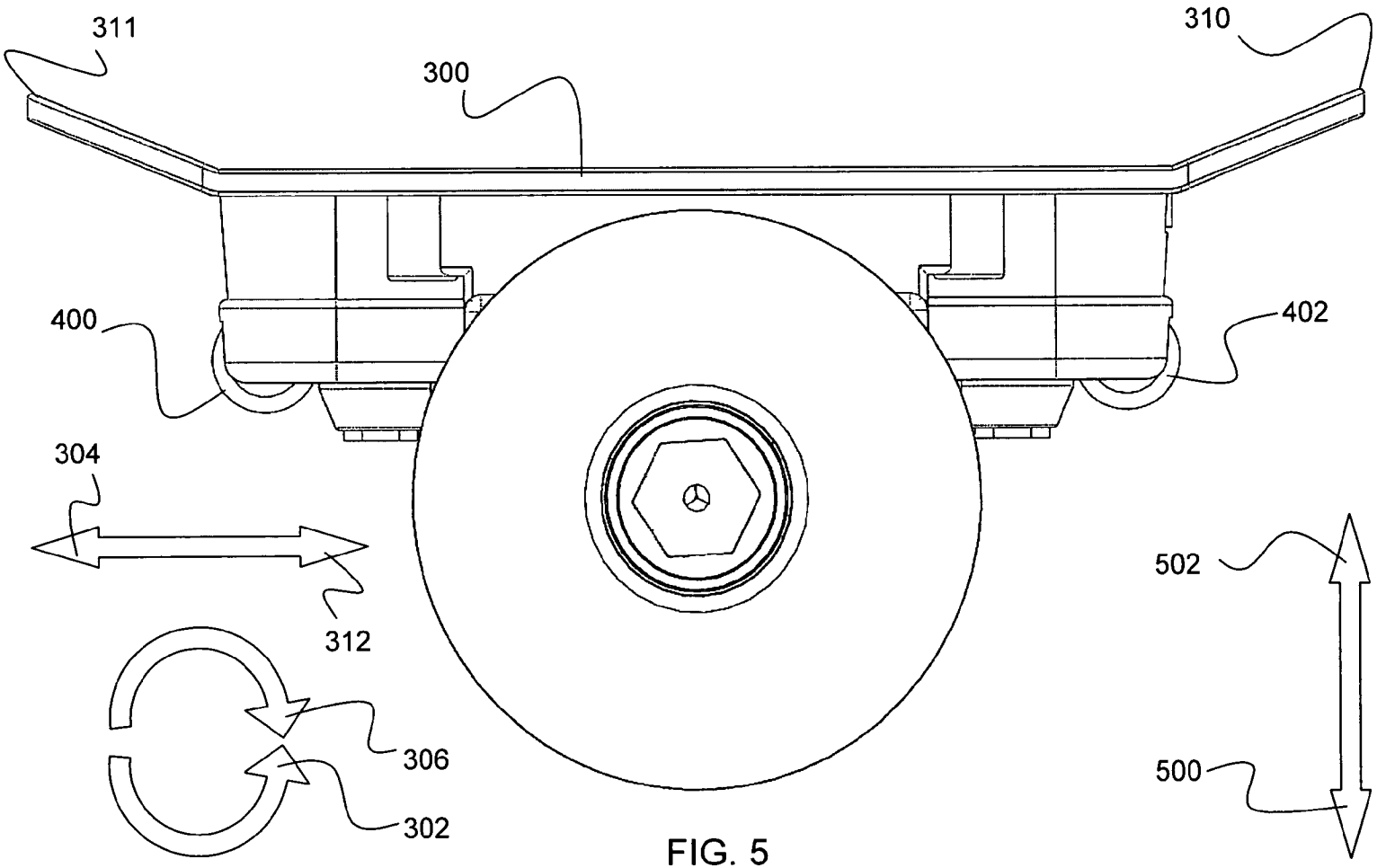
FIG. 5 is a side-view illustration of the dual-wheeled remotely controlled vehicle according to the present invention.

FIG. 5 is a side-view illustration of the RC vehicle 100. As shown in FIG. 5, when the motors are actuated in a clockwise direction 302 to propel the RC vehicle 100 forward 304, a counter-clockwise force 306 is applied to the body member 102 and its attached elongated member 300. Because of the counter-clockwise force 306, the first outer edge 310 is forced in a downward direction 500 to force the rear wheel 402 against the supporting surface. Conversely, when the motors are actuated in a counter-clockwise direction 306 to propel the RC vehicle 100 in reverse 312, an upward force 502 is applied to the first outer edge 310, thereby forcing the second outer edge 311 in a downward direction 500 to force the front wheel 400 against the supporting surface.

Figure 6:
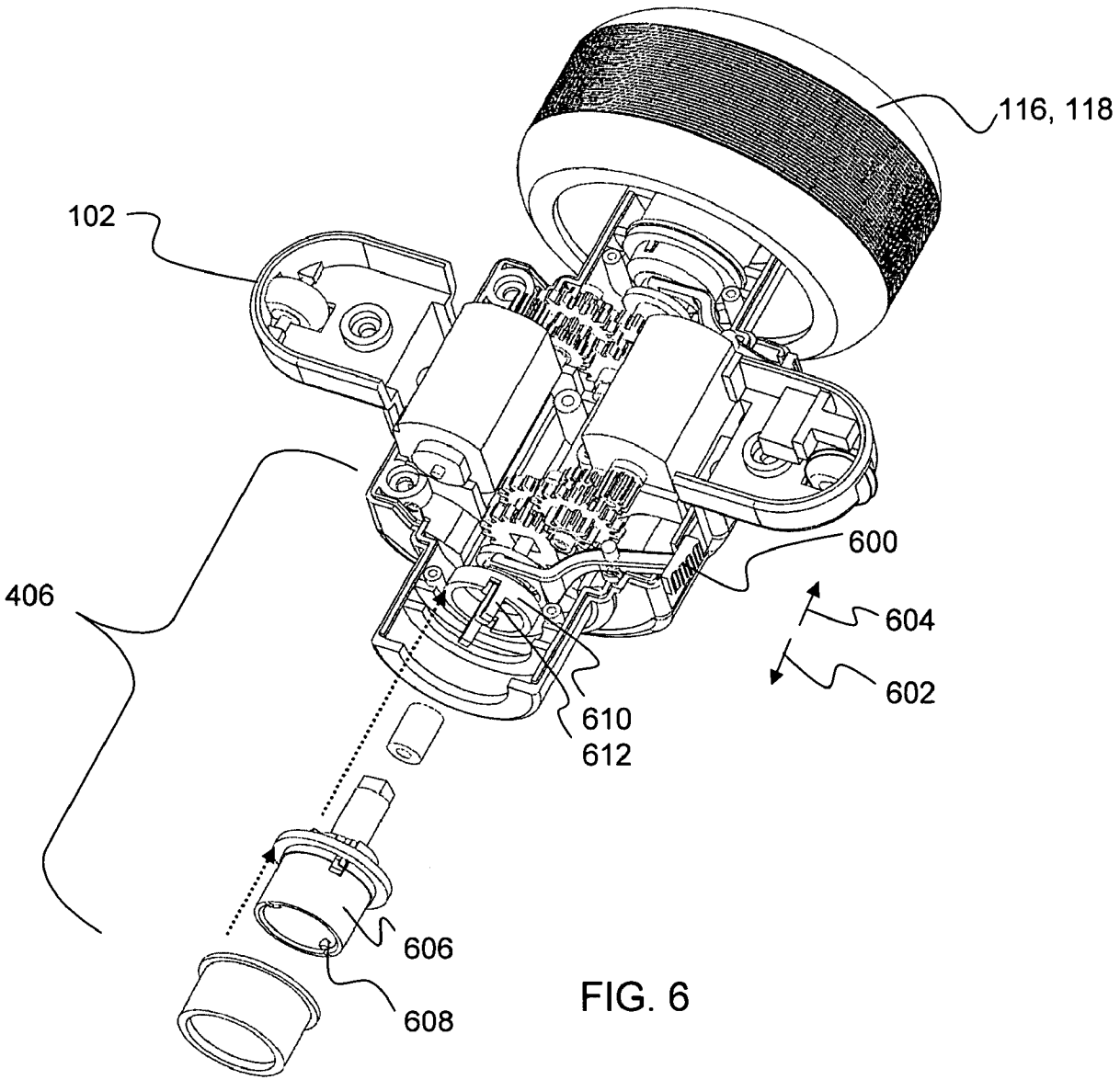
FIG. 6 is an interior-view illustration of the dual-wheeled remotely controlled vehicle according to the present invention, illustrating an exploded-view of a quick release apparatus.

As briefly described above, the wheels 116 and 118 are detachably attachable with the body member 102 through the use of a quick release apparatus 406. FIG. 6 illustrates an exploded view of the quick release apparatus 406. As shown in FIG. 6, the quick release apparatus 406 allows a user to selectively attach and detach the wheels. The quick release apparatus 406 is any suitable quick release mechanism for selectively attaching and detaching a toy wheel, a non-limiting example of which include a slide switch 600 that actuates an attachment/detachment mechanism. For example, the slide switch 600 is slid from its rest position and outwards 602 toward the wheels to operate the attachment/detachment mechanism to engage/disengage the wheel. When not in use, the slide switch springs back 604 into its rest position.

The quick release apparatus 406 further includes a drum 606 with a tab 608 therein. A withdrawing member 610 with a catch 612 protruding from it is connected with the slide switch 600. As will become apparent below, the tab 608 slides within a notch on a receiving element of the wheel, with the catch 612 affixing the wheel to the quick release apparatus 406. Using the slide switch 600 to withdraw the withdrawing member 610 and its catch 612 allows the wheel to disengage from the housing 102.

Figure 7:
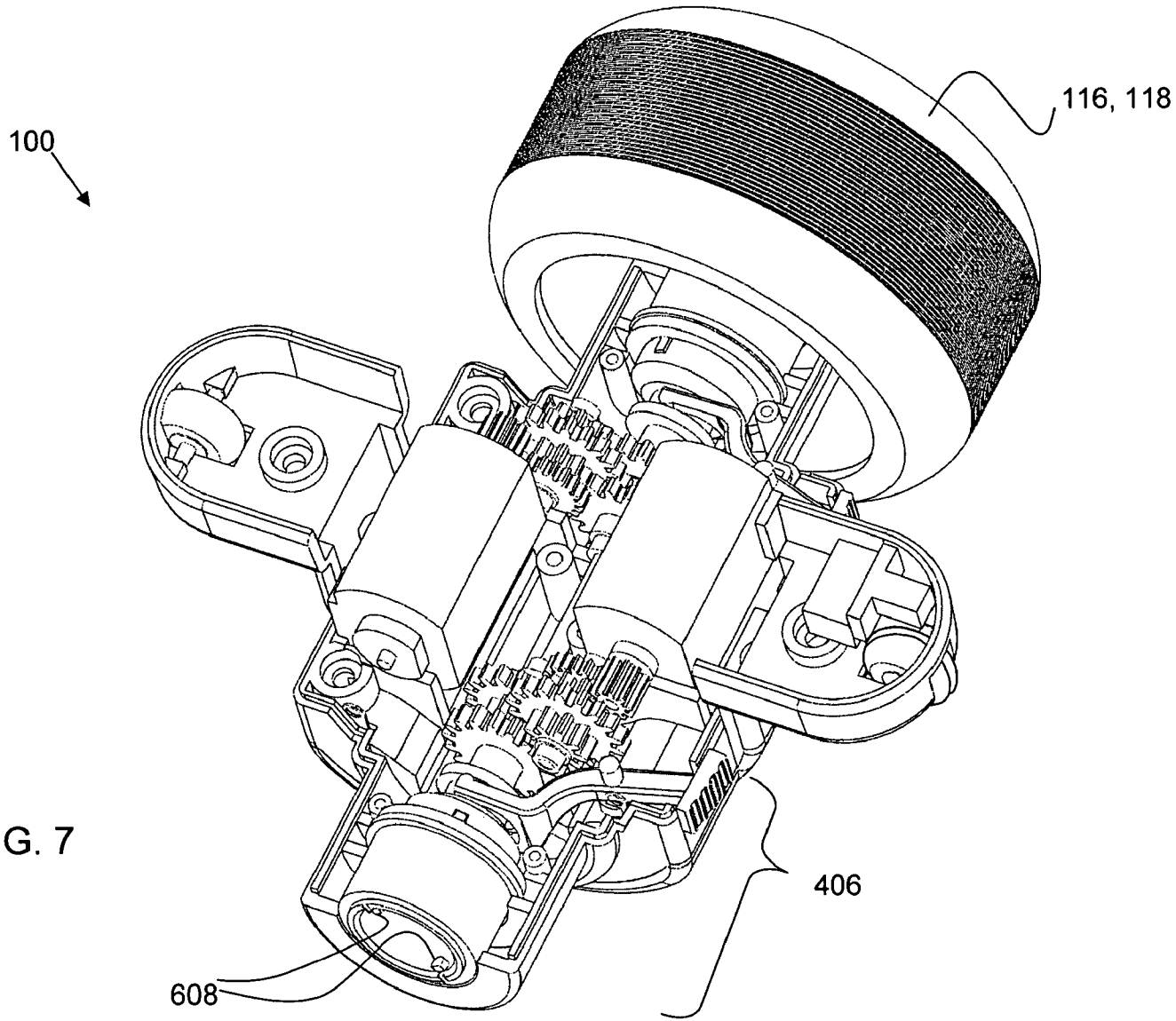
FIG. 7 is an interior-view illustration of the dual-wheeled remotely controlled vehicle according to the present invention, illustrating an assembled quick release apparatus.

FIG. 7 illustrates an internal view of the RC vehicle 100 with a fully assembled quick release apparatus 406.

Figure 8:
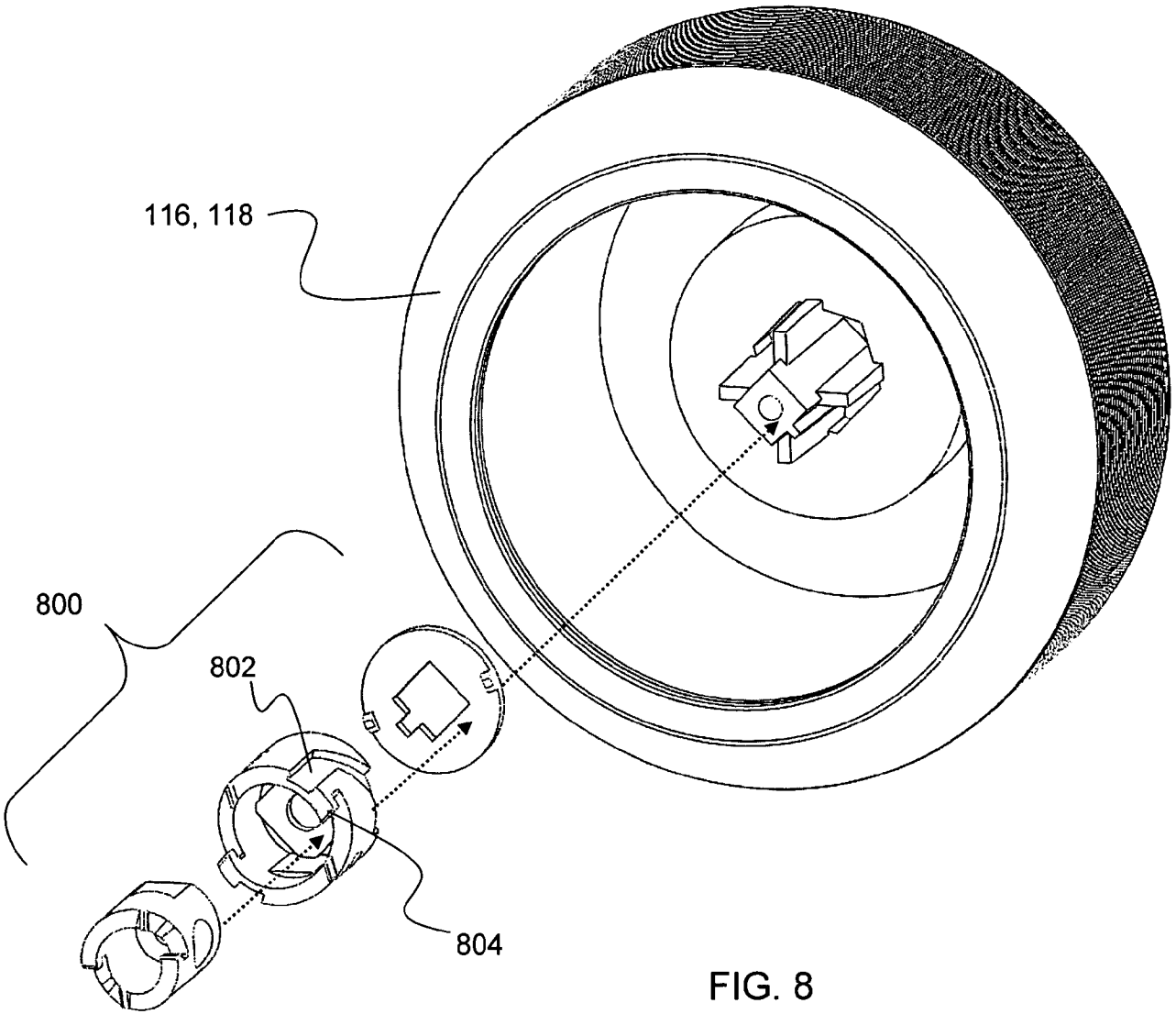
FIG. 8 is an exploded-view illustration of a receiving element being attached with a detachably attachable wheel.

FIG. 8 is an exploded view illustration of the wheel 116 or 118 and its receiving element 800. The receiving element 800 is formed in any suitable manner to be connected with the quick release mechanism. As a non-limiting example, the receiving element includes a notch 802 and a driving edge 804 formed therein.

As depicted in FIGS. 6 through 8, each wheel 116 and 118 is detachably attachable with a quick release mechanism 406. In attaching a wheel 116 or 118, the receiving element 800 is slid into the drum 606 such that the tab 608 slides within the notch 802. After sliding into place, the catch 612 is engaged with the driving edge 804 to affix the wheel 116 or 118 with the quick release mechanism 406. When attached with a wheel 116 or 118, the quick release apparatus 406 operates as a driving element to drive the wheel 116 or 118.

To remove the wheel 116 or 118, the slide switch 600 is used to withdraw the withdrawing member 610. Upon withdrawal, the catch 612 is withdrawn from the driving edge 804, thereby allowing the tab 608 to be slid out of the notch 802, resulting in the removal of the wheel 116 of 118.

In addition to changing the wheels for aesthetic purposes, different interchangeable wheels provided a variety of functional differences. For example, wheels with varying diameters provide for varying speeds. As such, it may be desirable to change the wheel with another interchangeable wheel to increase or decrease the speed of the RC vehicle 100. Because of this need and desire to change the wheels 116 and 118, the wheels 116 and 118 are formed to be interchangeable with other detachably attachable wheels. As such, the wheels 116 and 118 may be formed in a variety of shapes and sizes, so long as they are detachably attachable with the body member.

As can be appreciated by one in the art, the slide switch 600 can be placed at any suitable location on the body member 102 to provide for ease of access and quick release of the wheels 116 and 118.

Figure 9:
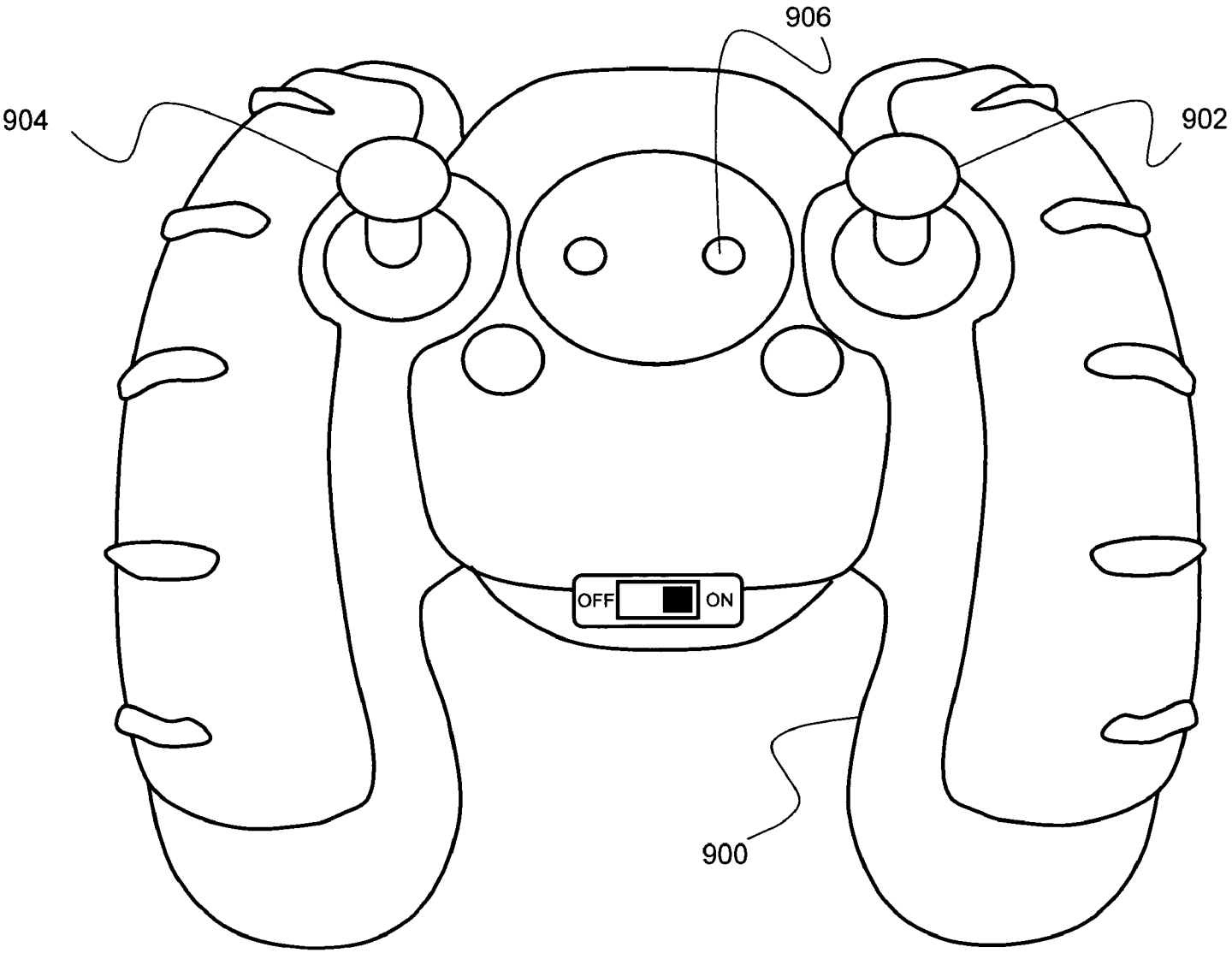
FIG. 9 is an illustration of a controller according to the present invention.

As shown in FIG. 9, the present invention further includes a remotely controlled (RC) transmitter 900 configured to transmit control signals to the receiver encased within the RC vehicle. The RC transmitter 900 includes at least two controllers, a first controller 902 and a second controller 904. The controllers 902 and 904 are any suitable switches for actuating the transmission of the control signals. The first controller 902 is configured to control the first motor and its corresponding right wheel, while the second controller 904 is configured to control the second motor and its corresponding left wheel. Through use of the RC transmitter 900, a user may control the RC vehicle and cause it to go in forward, reverse, left, and right directions. A light emitting diode (LED) 906 may also be included with the RC transmitter 900. The LED 906 is illuminated when the RC transmitter 900 is turned to an "on" position, and is turned off when the RC transmitter is turned to an "off" position.

As can be appreciated by one skilled in the art, the present invention also comprises a method for forming the remotely controlled vehicle described herein. The method includes acts of forming a body member 102; encasing a first motor 200 within the body member 102; encasing a second motor 202 within the body member 102; attaching a receiver 206 with the body member 102; attaching an elongated member 300 with the body member 102; and attaching a quick release mechanism 406 within the body member for quickly detaching and attaching the wheels 116 and 118. Additionally, as can be appreciated by one skilled in the art, the method further comprises acts of forming and attached all of the respective parts of the RC vehicle described herein.

(2.2.1) Toy for Rotating and Launching a Toy Wheel

Figure 10A:
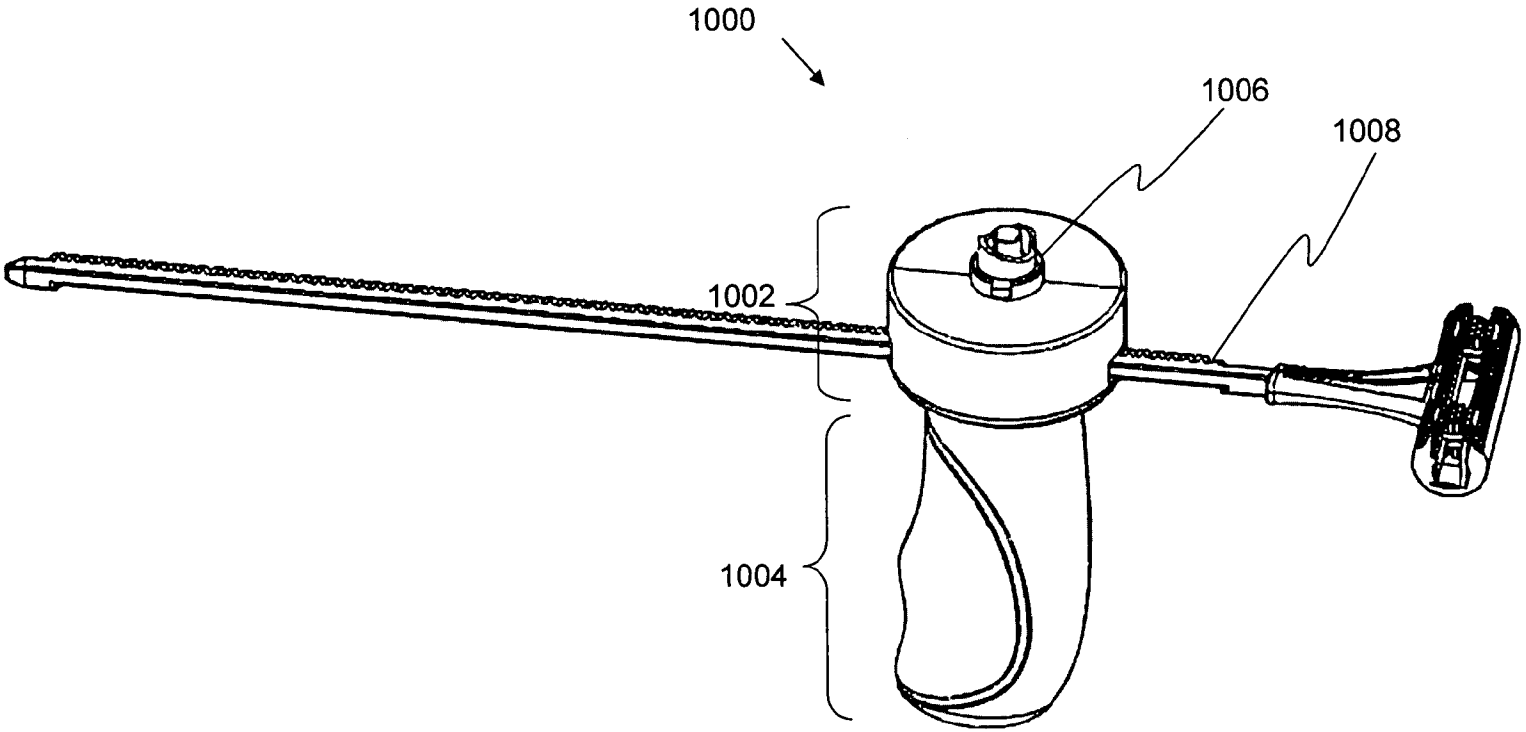
FIG. 10A is an exemplary illustration of a toy according to the present invention, depicting a housing, a handle, a launcher and a gear rack.
Figure 10B:
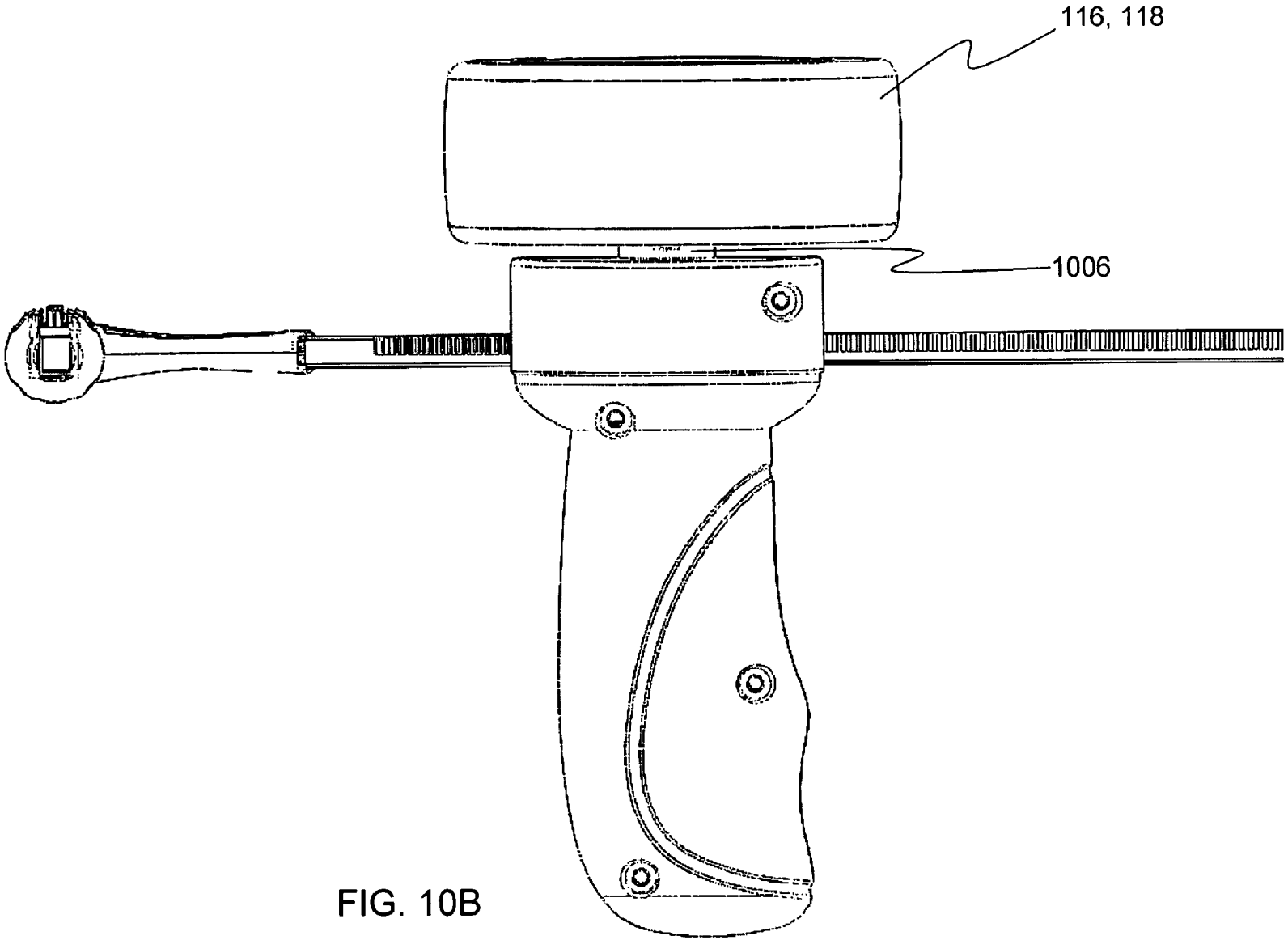
FIG. 10B is an exemplary illustration of a toy according to the present invention, depicting a wheel rotationally connected to the launcher.

As described above, the wheels 116 and 118 are formed to be used with a variety of devices. By way of example, the wheels are formed to be used with a toy for rotating and launching the wheels. In one aspect, as illustrated in FIG. 10A, the toy 1000 comprises a housing 1002, a handle 1004, a launcher 1006, and a launcher rotating system (not illustrated) including a gear rack 1008. The launcher rotating system is located inside the housing 1002, and the launcher rotating system is drivingly connected with the gear rack 108 such that when the gear rack 108 is moved, the launcher rotating system translates the movement of the gear rack 108 into a rotary motion. The launcher rotating system is then drivingly connected with the launcher 1006. When an object such as a wheel 116 or 118 is connected with the launcher 1006, as in FIG. 10B, the launcher 1006 rotationally accelerates the wheel 116 or 118 until the wheel 116 or 118 is released from the launcher 1006 and propelled forward.

Although a gear rack 1008 is shown in the aspect of FIG. 10A, one skilled in the art will appreciate that the launcher rotating system can comprise a motor or other manually operated mechanism to cause the rotation of the launcher 1006.

What is claimed is:

1. A remotely controlled vehicle comprising:

a body member having a left portion, a right portion, a top portion, a bottom portion, a front portion, and a rear portion;

a first motor attached with the body member for coupling with and driving right wheel;

a second motor attached with the body member for coupling with and driving a left wheel;

a receiver attached with the body member for receiving control signals from a remotely controlled transmitter, the receiver being independently connected with both the first and second motors such that a control signal from the remotely controlled transmitter provides for independent control of each of the first and second motors and their respective right and left wheels;

an elongated member connected with the top portion that extends beyond both the front portion and the rear portion, and where the elongated member further extends beyond the peripheral portions of the wheels, such that when the wheels are attached and engaged, the elongated member is forced toward a supporting surface, thereby preventing the body member from continuously spinning in place, whereby through use of a remotely controlled transmitter, a user can independently control each of the first and second motors, such that if the wheels are attached, uni-engagement of the left or right wheels alone causes the remotely controlled vehicle to turn, and bi-engagement of both the right and left wheels in opposite directions also causes the remotely controlled vehicle to turn, while bi-engagement in the same direction causes the remotely controlled vehicle to propel itself forward or reverse, thereby allowing a user to maneuver the remotely controlled vehicle in forward, reverse, left, and right directions;

wherein the elongated member is formed as a skateboard deck such that the remotely controlled vehicle is a dual-wheeled, remotely controlled skateboard;

a detachably attachable right wheel for drivably coupling with the first motor and rotationally mounted proximate the right portion of the body member for supporting the body member on a supporting surface, the right wheel having dimensions and a peripheral portion such that the peripheral portion of the right wheel extends beyond the bottom portion of the body member;

a detachably attachable left wheel drivably for coupling with the second motor and rotationally mounted proximate the left portion of the body member for supporting the body member on the supporting surface, the left wheel having dimensions and a peripheral portion such that the peripheral portion of the left wheel extends beyond the bottom portion of the body member;

a front wheel and a rear wheel rotatably attached with the front and rear portions respectively, such that when the detachably attachable wheels are attached and engaged, the elongated member is forced toward the supporting surface so that both the detachably attachable wheels and one of the front wheel and rear wheel engage with the supporting surface, depending upon directional engagement of the detachably attachable wheels;

wherein each detachably attachable wheel further comprises a receiving element, the receiving element including a notch and driving edge formed therein;

a quick release apparatus attached with the body member for attaching the detachably attachable wheels, such that the detachably attachable wheels are detachably attachable with the body member through the use of the quick release apparatus, where actuation of the quick release apparatus releases at least one wheel, allowing for placement of another interchangeable wheel, wherein the quick release apparatus further comprises:

a slide switch attached with the body member;

a drum having tabs attached with the body member;

a withdrawing member attached with the body member and operably connected with the slide switch, the withdrawing member having a catch for engaging with a driving edge of the receiving element, whereby a detachably attachable wheel may be attached with the quick release apparatus by sliding the receiving element into the drum such that the tab slides within the notch, the catch thereafter engaged with the driving edge, and when detaching the detachably attachable wheel, the slide switch is used to withdraw the withdrawing member such that the catch is withdrawn from the driving edge, thereby allowing the tab to be slid out of the notch which results in the removal of the detachably attachable wheel.

2. A remotely controlled vehicle as set forth in claim 1, further comprising a remotely controlled transmitter configured to transmit control signals to the receiver, the remotely controlled transmitter having a first controller and a second controller, where the first controller is configured to control the first motor and its corresponding right wheel, and where the second controller is configured to control the second motor and its corresponding left wheel.

3. A remotely controlled vehicle as set forth in claim 2, wherein each motor is drivably coupled with a detachably attachable wheel through a driving element attached with each motor and a receiving element attached with each detachably attachable wheel, where the driving element is configured to engage with and impart a rotary motion to the receiving element.

4. A remotely controlled vehicle comprising:

a body member having a left portion, a right portion, a top portion, a bottom portion, a front portion, and a rear portion;

a first motor attached with the body member for coupling with and driving right wheel;

a second motor attached with the body member for coupling with and driving a left wheel;

a receiver attached with the body member for receiving control signals from a remotely controlled transmitter, the receiver being independently connected with both the first and second motors such that a control signal from the remotely controlled transmitter provides for independent control of each of the first and second motors and their respective right and left wheels;

an elongated member connected with the top portion that extends beyond both the front portion and the rear portion, and where the elongated member further extends beyond the peripheral portions of the wheels, such that when the wheels are attached and engaged, the elongated member is forced toward a supporting surface, thereby preventing the body member from continuously spinning in place, whereby through use of a remotely controlled transmitter, a user can independently control each of the first and second motors, such that if the wheels are attached, uni-engagement of the left or right wheels alone causes the remotely controlled vehicle to turn, and bi-engagement of both the right and left wheels in opposite directions also causes the remotely controlled vehicle to turn, while bi-engagement in the same direction causes the remotely controlled vehicle to propel itself forward or reverse, thereby allowing a user to maneuver the remotely controlled vehicle in forward, reverse, left, and right directions;

a detachably attachable right wheel for drivably coupling with the first motor and rotationally mounted proximate the right portion of the body member for supporting the body member on a supporting surface, the right wheel having dimensions and a peripheral portion such that the peripheral portion of the right wheel extends beyond the bottom portion of the body member;

a detachably attachable left wheel drivably for coupling with the second motor and rotationally mounted proximate the left portion of the body member for supporting the body member on the supporting surface, the left wheel having dimensions and a peripheral portion such that the peripheral portion of the left wheel extends beyond the bottom portion of the body member;

wherein each detachably attachable wheel further comprises a receiving element, the receiving element including a notch and driving edge formed therein; and a quick release apparatus comprising:

a slide switch attached with the body member;

a drum having tabs attached with the body member;

a withdrawing member attached with the body member and operably connected with the slide switch, the withdrawing member having a catch for engaging with a driving edge of the receiving element, whereby a detachably attachable wheel may be attached with the quick release apparatus by sliding the receiving element into the drum such that the tab slides within the notch, the catch thereafter engaged with the driving edge, and when detaching the detachably attachable wheel, the slide switch is used to withdraw the withdrawing member such that the catch is withdrawn from the driving edge, thereby allowing the tab to be slid out of the notch which results in the removal of the detachably attachable wheel.

* * * * *